US006206737B1

(12) United States Patent
Bonilla et al.

(10) Patent No.: US 6,206,737 B1
(45) Date of Patent: Mar. 27, 2001

(54) ENHANCED TERMINAL SCREW WITH IMPELLER WIRE GRIPPING ELEMENTS

(75) Inventors: Nelson Bonilla, West Haven; Stephen R. Ewer, Milford, both of CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/253,561

(22) Filed: Feb. 19, 1999

(51) Int. Cl.[7] ..... H01R 4/30; H01R 4/46
(52) U.S. Cl. ..... 439/801; 411/188
(58) Field of Search ..... 439/801, 808; 411/185, 186, 187, 188, 189

(56) References Cited

U.S. PATENT DOCUMENTS

| | | | | |
|---|---|---|---|---|
| 2,037,586 | * | 4/1936 | Olson | 411/187 |
| 3,438,417 | * | 4/1969 | Albris | 411/185 |
| 3,694,790 | | 9/1972 | Martin | 339/14 R |
| 4,123,132 | | 10/1978 | Hardy et al. | 339/246 |
| 4,220,188 | * | 9/1980 | McMurray | 411/188 |
| 4,290,469 | * | 9/1981 | Nakae | 411/185 |
| 4,310,272 | * | 1/1982 | Rich et al. | 411/185 |
| 4,490,082 | * | 12/1984 | Barth | 411/185 |
| 4,808,050 | * | 2/1989 | Landt | 411/188 |
| 4,854,885 | | 8/1989 | Bowden, Jr. et al. | 439/107 |
| 4,924,213 | | 5/1990 | Decho et al. | 380/653 |
| 5,713,766 | | 2/1998 | Davies et al. | 439/709 |
| 5,741,161 | | 4/1998 | Cahaly et al. | 439/709 |

FOREIGN PATENT DOCUMENTS

| | | | | |
|---|---|---|---|---|
| 2908499 | * | 9/1980 | (DE) | 411/188 |

* cited by examiner

*Primary Examiner*—Paula Bradley
*Assistant Examiner*—Antoine Ngandjui
(74) *Attorney, Agent, or Firm*—Michael R. Swartz; Jerry M. Presson

(57) ABSTRACT

An enhanced terminal screw for use in an electrical receptacle includes a shank, a head and a plurality of impeller wire gripping elements. The shank has opposite ends. The head is mounted to one of the opposite ends of the shank. The head has an underside surface defining a plurality of spaced apart grooves. The impeller wire gripping elements are defined by a plurality of lands formed between the spaced apart grooves on the underside surface of the head which grip a wire partially surrounding the shank and wrap the wire radially inwardly toward the shank as the screw is tightened relative to the wire. Each land has opposite edges providing a gripping surface.

3 Claims, 12 Drawing Sheets

ENHANCED TERMINAL SCREW WITH IMPELLER WIRE GRIPPING ELEMENTS

CROSS REFERENCE TO RELATED APPLICATIONS

Reference is hereby made to the following copending U.S. applications dealing with subject matter related to the present invention and assigned to the same assignee as the present invention:

1. "Contact Terminal Assembly With Back Wired Clamping Arrangement" by Nelson Bonilla and Stephen R. Ewer, assigned U.S. Ser. No. 09/253,563 and filed Feb. 19, 1999.

2. "Four-Sided Ground Contact Assembly" by Nelson Bonilla and Stephen R. Ewer, assigned U.S. Ser. No. 09/253,564 and filed Feb. 19, 1999.

3. "Mounting Bridge With Enhanced Barbs For Biting Into Three Sides Of Receptacle Body Slots" by Nelson Bonilla and Stephen R. Ewer, assigned U.S. Ser. No. 09/253,562 and filed Feb. 19, 1999.

BACKGROUND OF THE INVENTION

1. Field of the Invention

The present invention generally relates to electrical equipment and, more particularly, is concerned with a terminal screw with impeller wire gripping elements for use in an electrical receptacle.

2. Description of the Prior Art

Heretofore, some electrical receptacles manufactured and marketed by Hubbell Incorporated of Orange, Conn., the assignee of the subject application, have employed a receptacle body with plug terminal contact receiving openings formed on its front side, a base body which mates with the receptacle body, a plurality of contact terminal assemblies fitted with cavities in the receptacle and base bodies, and an U-shaped mounting bridge provided with a base portion positioned adjacent a rear face of the base body and a pair of opposite leg portions extending forwardly from opposite ends of the base portion along opposite ends of the base and receptacle bodies, securing the receptacle and base bodies together in a mated relationship and capturing the contact terminal assemblies therein. The mounting bridge also has mounting tabs attached to the opposite leg portions and extending outwardly therefrom in opposite directions with holes on the mounting tabs for fastening the electrical receptacle to an external structure, such as a building wall, by the use of screws inserted through the holes and threaded into the structure.

While the above-described electrical receptacle has functioned satisfactorily under the range of conditions for which it was designed, as with any product certain drawbacks have been noted from time to time. One drawback particularly concerns the terminal screws used in the side wiring contact terminal assemblies. Side wiring is where the wire end is inserted from a side of the receptacle and partially around the terminal screw and then the screw is tightened against the wire. The prior art screw has a shank with a head thereon with a relatively smooth underside which in applying pressure on the wire end has the tendency to cause the wire to move away from the shank of the screw and thereby reduce the effectiveness of the electrical connection therewith.

Consequently, the inventors herein have perceived a need to provide further innovations which will overcome the above noted drawback.

SUMMARY OF THE INVENTION

The present invention provides an enhanced terminal screw designed to satisfy the aforementioned need. The enhanced terminal screw of the present invention is advantageously provided with impeller wire gripping elements which grip a wire that partially surrounds the screw and wrap or pull the wire radially inwardly toward the center of the screw as the screw is being tightened relative to the wire.

Accordingly, the present invention is directed to an enhanced terminal screw with impeller wire gripping elements for use in an electrical receptacle. The enhanced terminal screw comprises: (a) shank having opposite ends; (b) a head mounted to one of the opposite ends of the shank and having an underside surface; and (c) a plurality of impeller wire gripping elements formed on the underside surface of the head which grip a wire partially surrounding the shank and wrap the wire radially inwardly toward the shank as the screw is tightened relative to the wire.

More particularly, the impeller wire gripping elements are spirally arranged on the underside surface of the head. The impeller wire gripping elements are symmetrically arranged about the shank. Each impeller wire gripping element has an arcuate shape. The underside surface of the head defines a plurality of spaced apart grooves. The impeller wire gripping elements are a plurality of lands formed between the spaced apart grooves on the underside surface of the head. Each land has opposite edges which provide a gripping surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
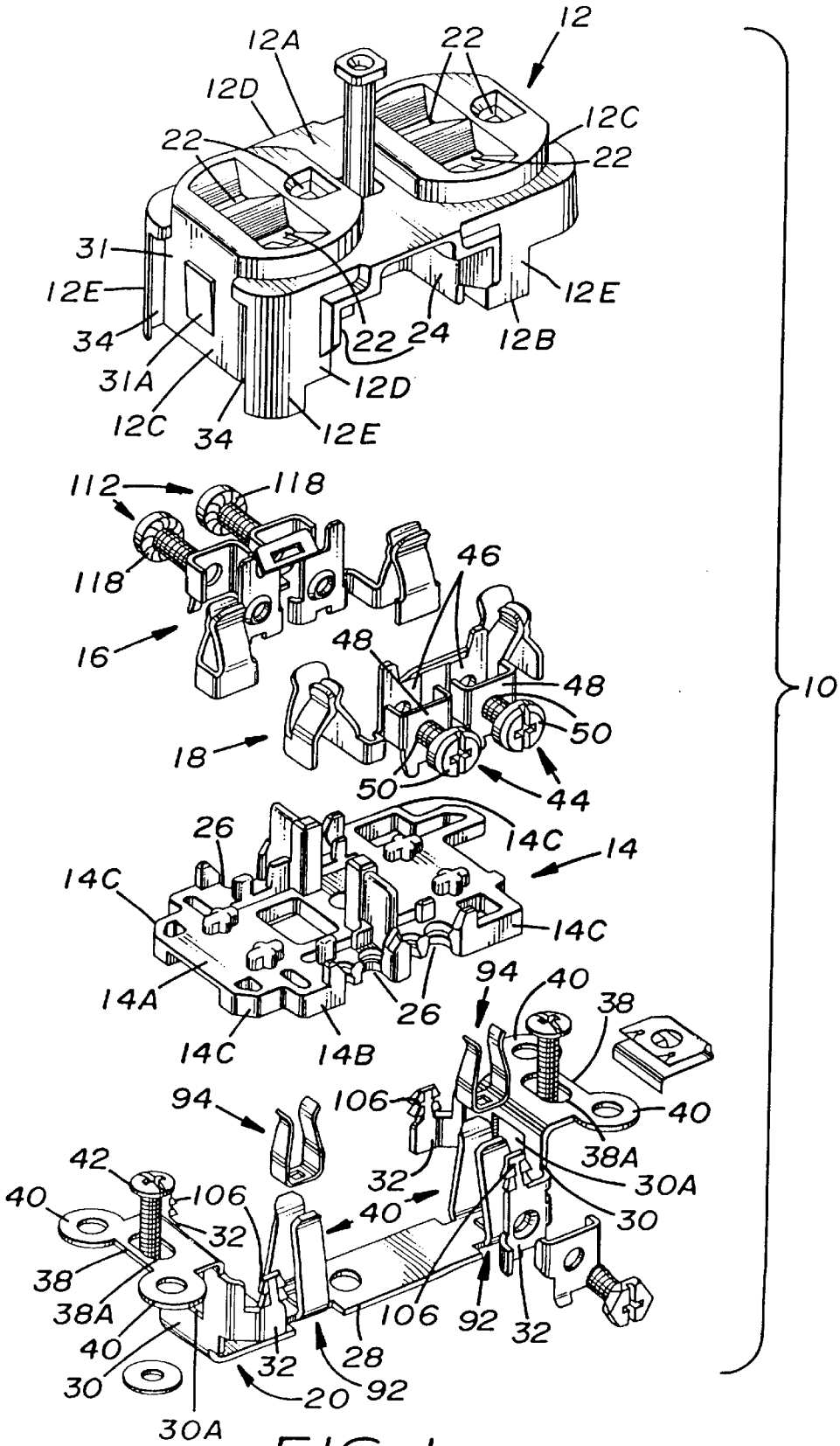
FIG. 1 is an exploded view of an electrical receptacle incorporating the features of the present invention as well as the features of the other inventions of the applications cross-referenced above.
Figure 2:
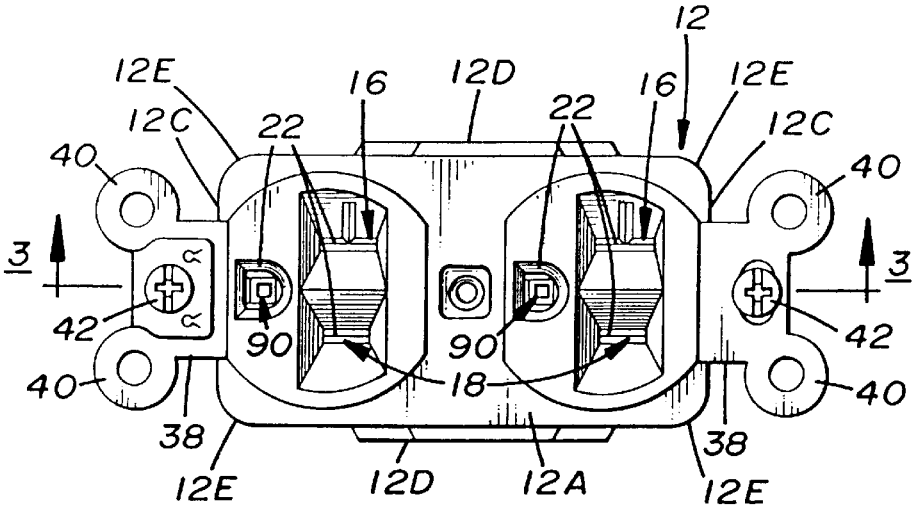
FIG. 2 is a front plan view of the receptacle of FIG. 1 having a pair of four-sided ground contact assemblies which constitute the invention of the second cross-referenced application.
Figure 3:
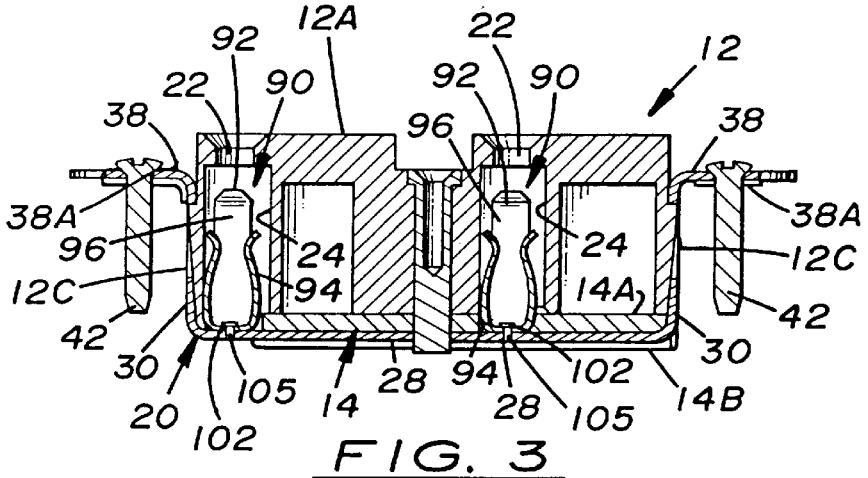
FIG. 3 is a longitudinal sectional view of the receptacle taken along line 3—3 of FIG. 2 showing the four-sided ground contact assemblies mounted on a mounting bridge of the receptacle.
Figure 4:
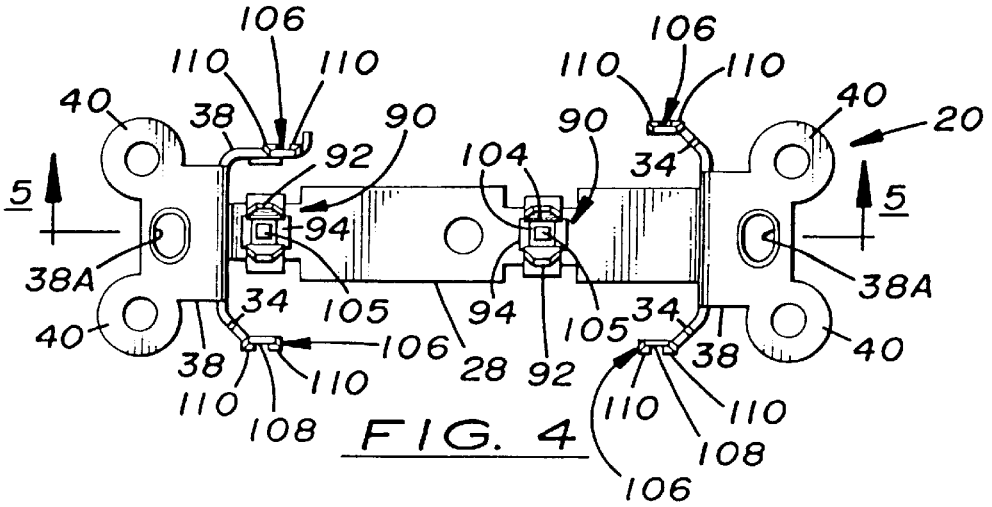
FIG. 4 is a front plan view of the bridge removed from the receptacle, showing on the bridge the four-sided ground contact assemblies and enhanced barbs which respectively constitute the inventions of the second and third cross-referenced applications.
Figure 5:
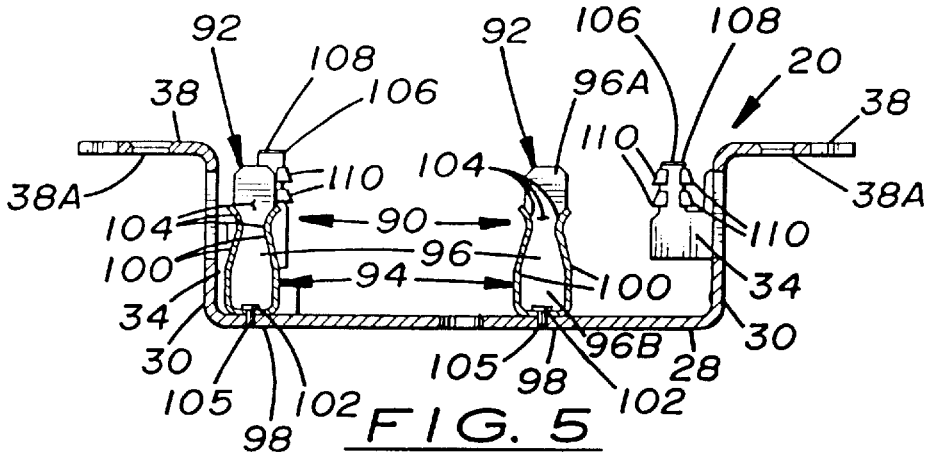
FIG. 5 is a longitudinal sectional view of the bridge taken along line 5—5 of FIG. 4.
Figure 6:
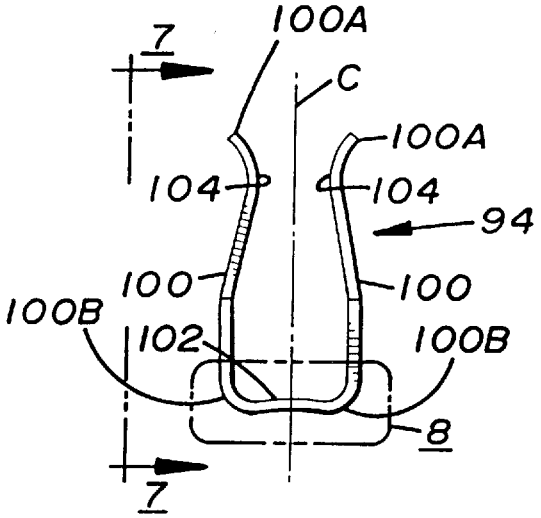
FIG. 6 is an enlarged side elevational view of a pair of auxiliary contacts in each four-sided ground contact assembly.
Figure 7:
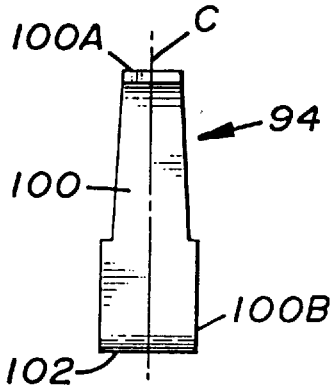
FIG. 7 is an end elevational view of the auxiliary contacts as seen along line 7—7 of FIG. 6.
Figure 8:
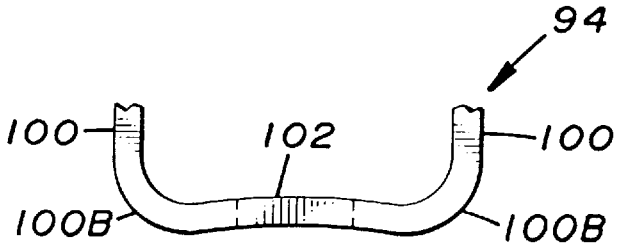
FIG. 8 is an enlarged detailed view of a connecting portion of the auxiliary contacts enclosed by oval 8 of FIG. 7.
Figure 10:
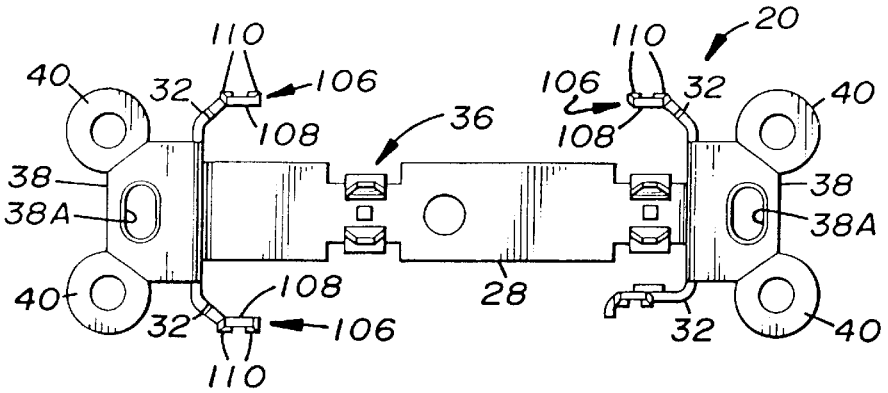
FIG. 10 is a front plan view of the bridge as seen along line 10—10 of FIG. 9.
Figure 9:
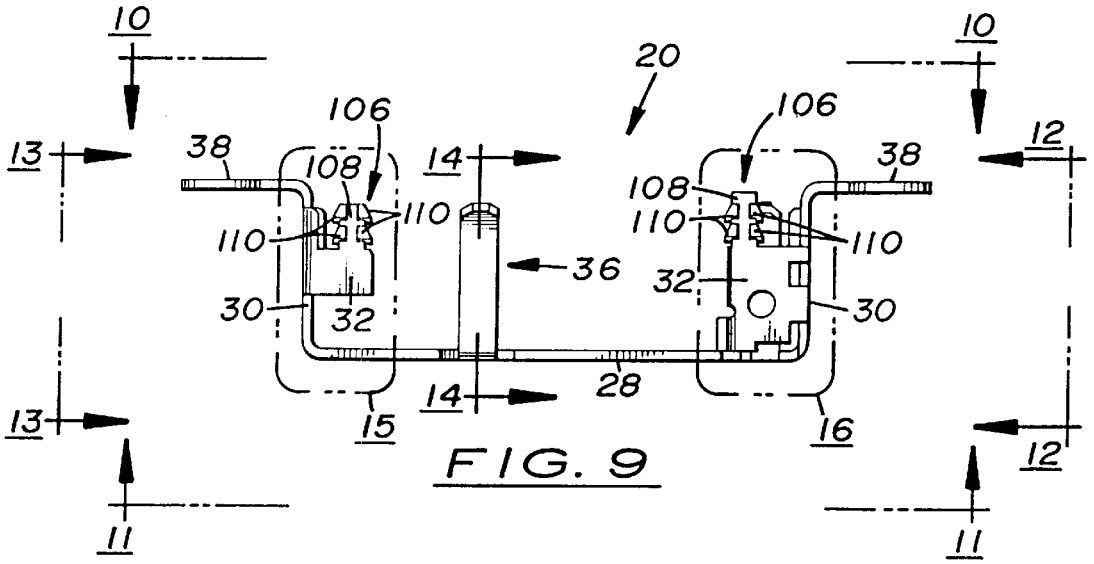
FIG. 9 is a side elevational view of an alternate mounting bridge for the receptacle having only the enhanced barbs on the bridge constituting the invention of the third cross-referenced application.
Figure 11:
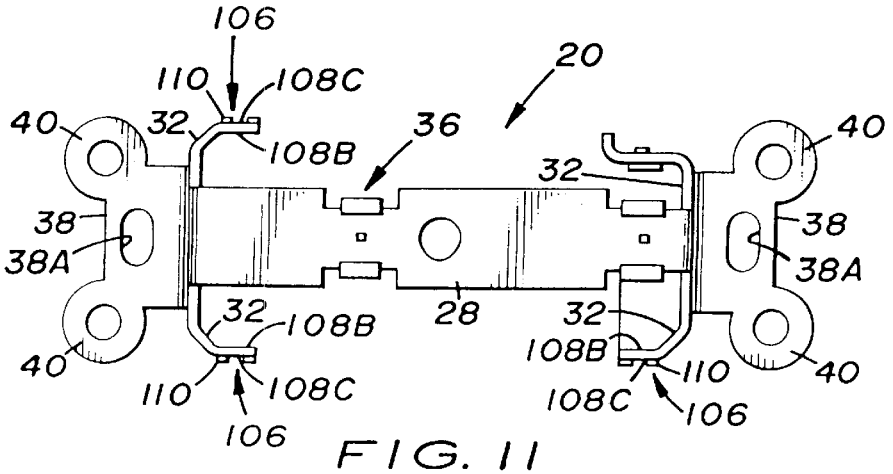
FIG. 11 is a rear plan view of the bridge as seen along line 11—11 of FIG. 9.
Figure 14:
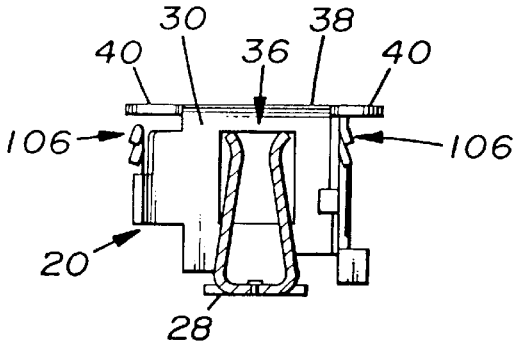
FIG. 14 is a fragmentary cross-sectional view of the bridge taken along line 14—14 of FIG. 9.
Figure 13:
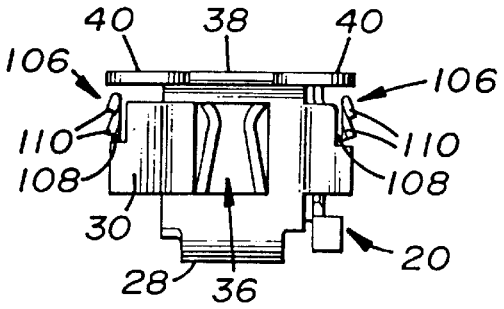
FIG. 13 is an opposite end elevational view of the bridge as seen along line 13—13 of FIG. 9.
Figure 12:
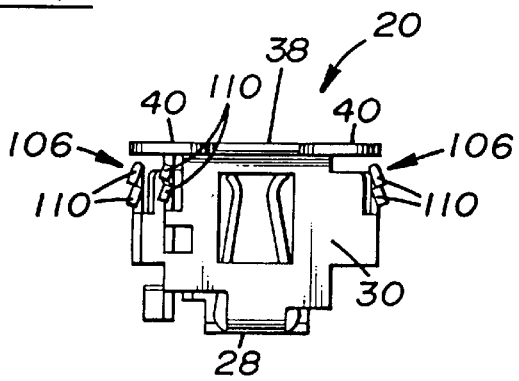
FIG. 12 is an end elevational view of the bridge as seen along line 12—12 of FIG. 9.
Figure 15:
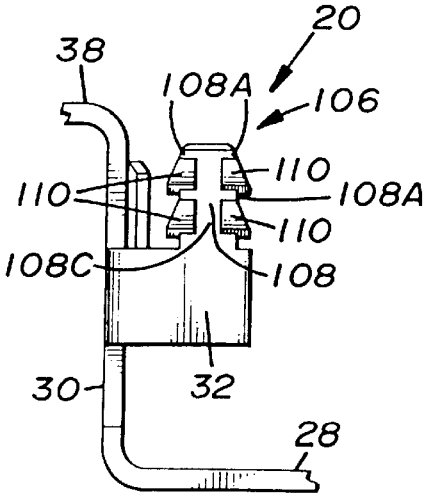
FIG. 15 is an enlarged detailed view of a portion of the bridge enclosed by oval 15 of FIG. 9 having one of the enhanced barbs thereon.
Figure 16:
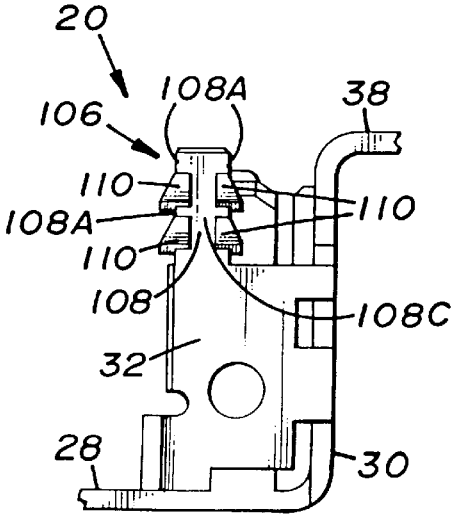
FIG. 16 is another enlarged detailed view of a portion of the bridge enclosed by oval 16 of FIG. 9 having another of the enhanced barbs thereon.
Figure 17:
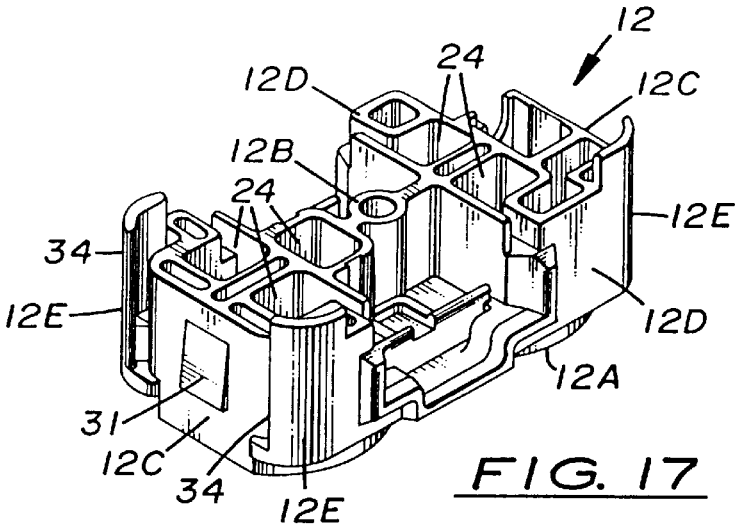
FIG. 17 is a rear perspective view of a receptacle body of the receptacle of FIG. 1.
Figure 19:
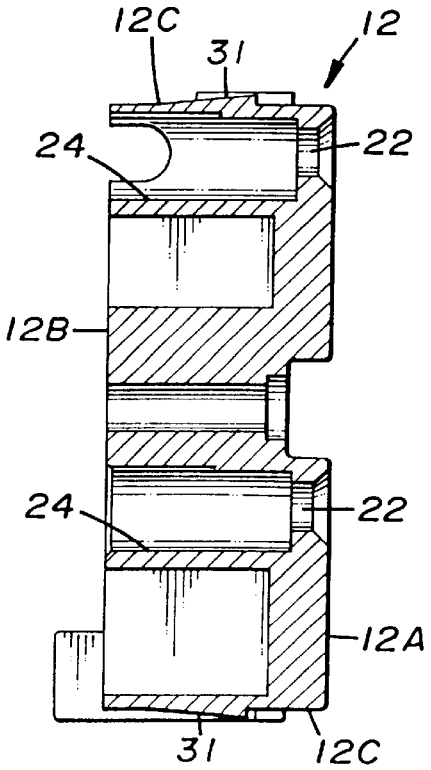
FIG. 19 is a longitudinal sectional view of the receptacle body taken along line 19—19 of FIG. 18.
Figure 18:
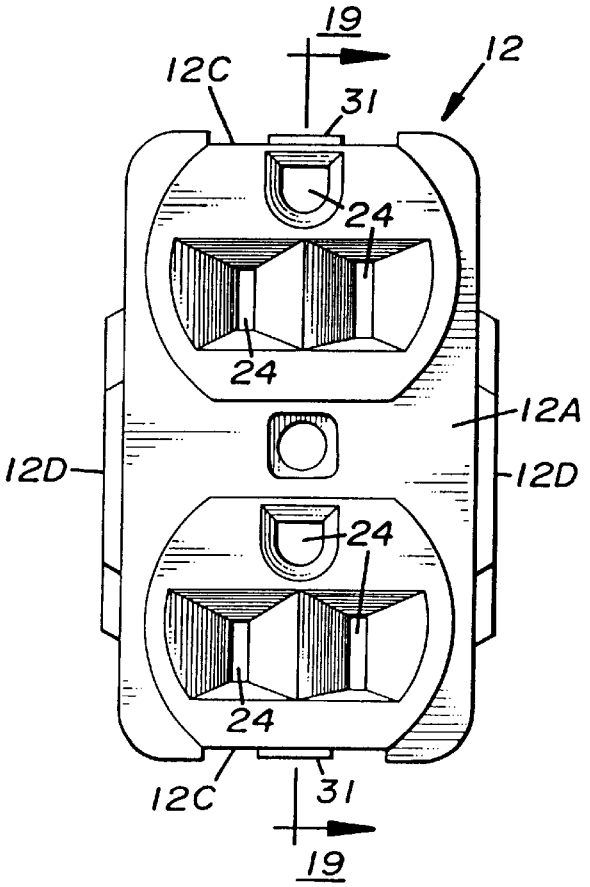
FIG. 18 is a front plan view of the receptacle body of FIG. 17.
Figure 21:
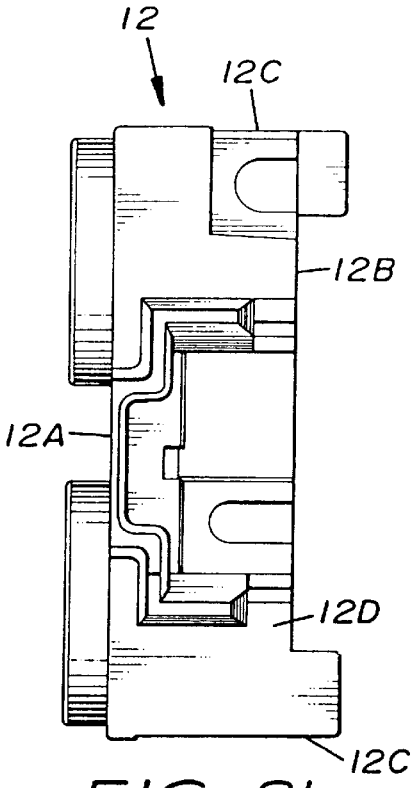
FIG. 21 is a side elevational view of the receptacle body as seen along line 21—21 of FIG. 20.
Figure 20:
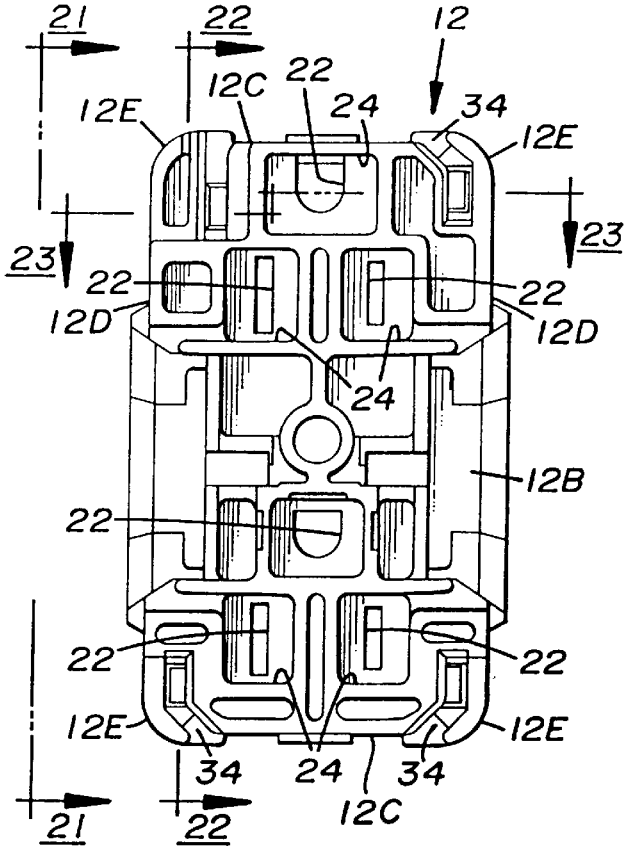
FIG. 20 is a rear plan view of the receptacle body of FIG. 17.
Figure 22:
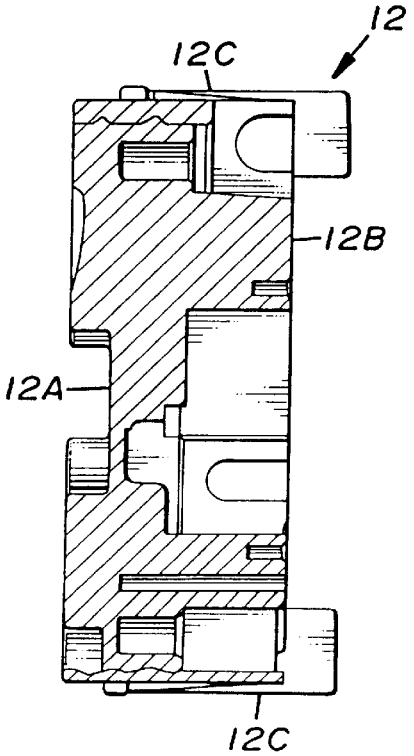
FIG. 22 is a longitudinal sectional view of the receptacle body taken along line 22—22 of FIG. 20.
Figure 23:
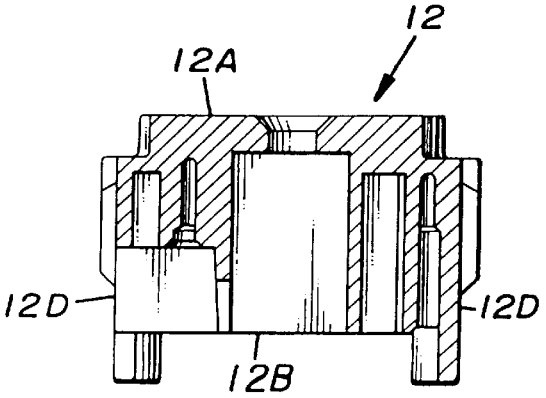
FIG. 23 is a cross-sectional view of the receptacle body taken along line 23—23 of FIG. 20.
Figure 24:
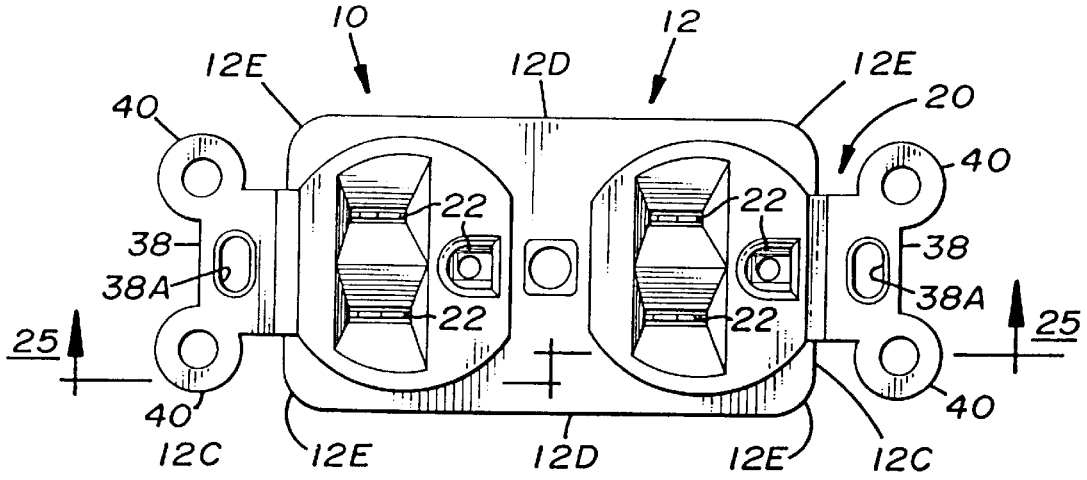
FIG. 24 is a front plan view of the receptacle of FIG. 1 in assembled form in which the receptacle and base bodies are mated together and retained in the mated relationship by the mounting bridge and the multiple barbs thereon.
Figure 25:
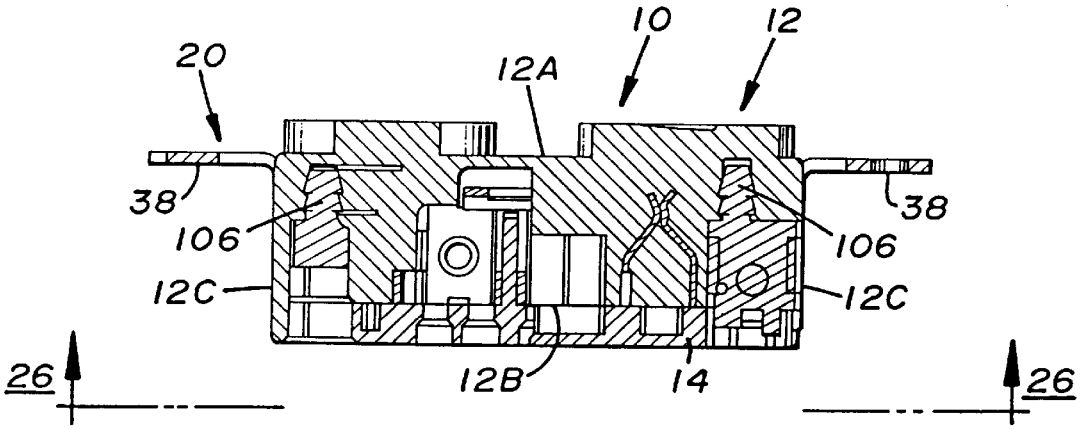
FIG. 25 is a longitudinal sectional view of the assembled receptacle taken along line 25—25 of FIG. 24.
Figure 26:
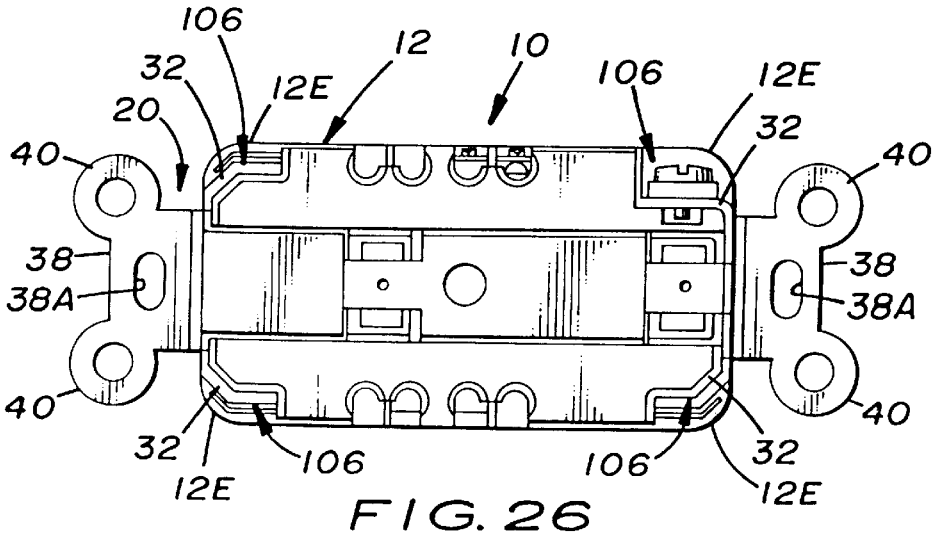
FIG. 26 is a rear plan view of the assembled receptacle as seen along line 26—26 of FIG. 25.
Figure 27:
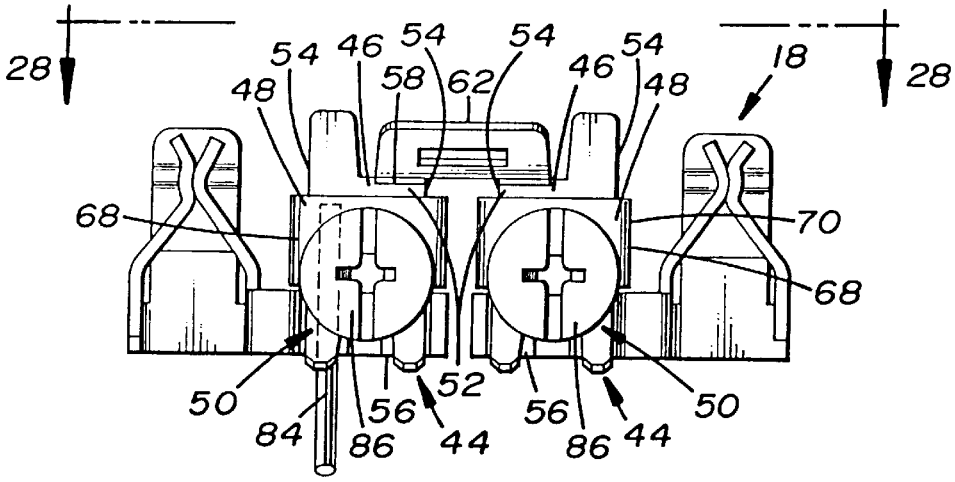
FIG. 27 is a side elevational view of a back wired clamping arrangement constituting the invention of the first cross-referenced application and incorporated in a contact terminal assembly of the receptacle of FIG. 1.
Figure 28:
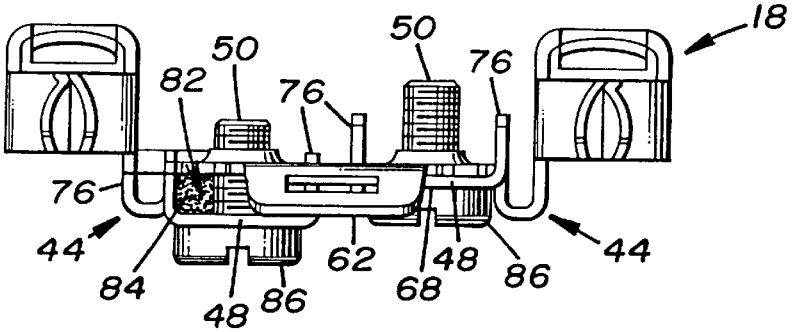
FIG. 28 is a front plan view of the back wired clamping arrangement as seen along line 28—28 of FIG. 27.
Figure 29:
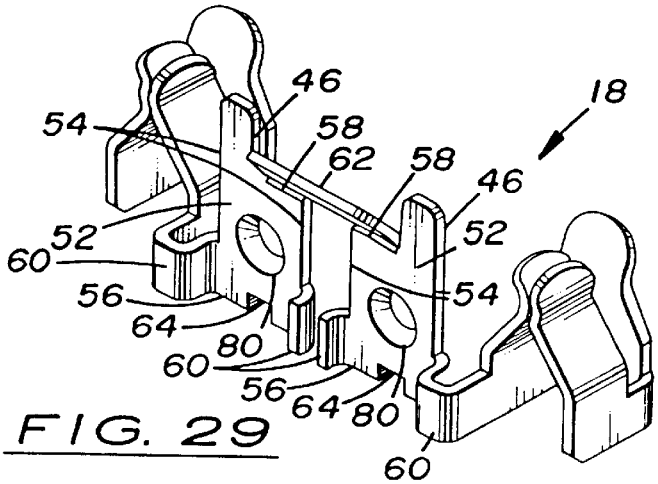
FIG. 29 is a perspective view of a contact terminal assembly having a pair of base plates of the back wired clamping arrangement of FIG. 27.
Figure 30:
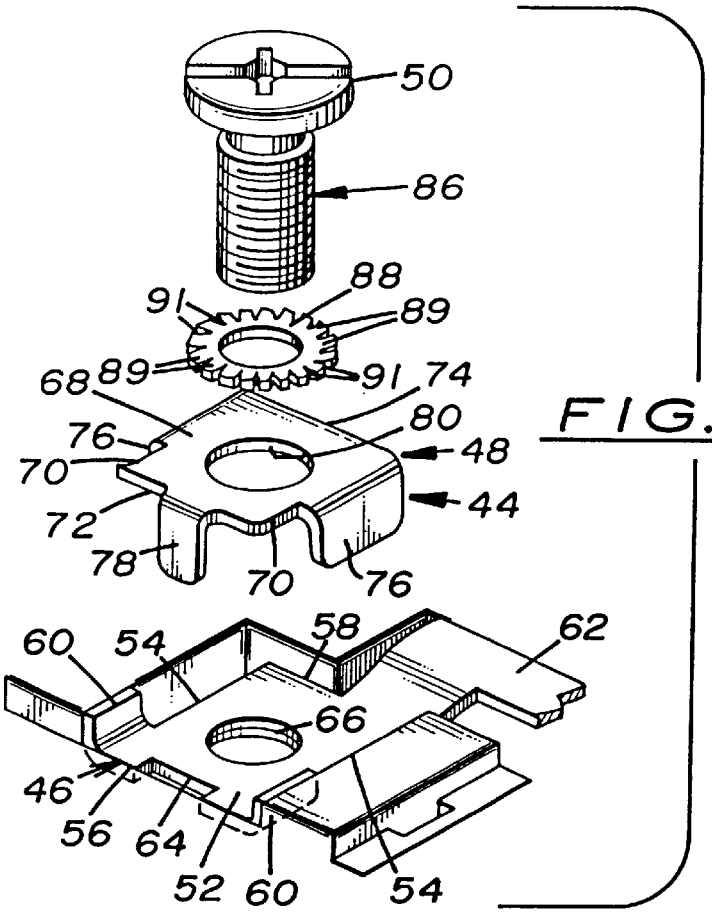
FIG. 30 is an exploded perspective view of the back wired clamping arrangement of FIG. 27.
Figure 31:
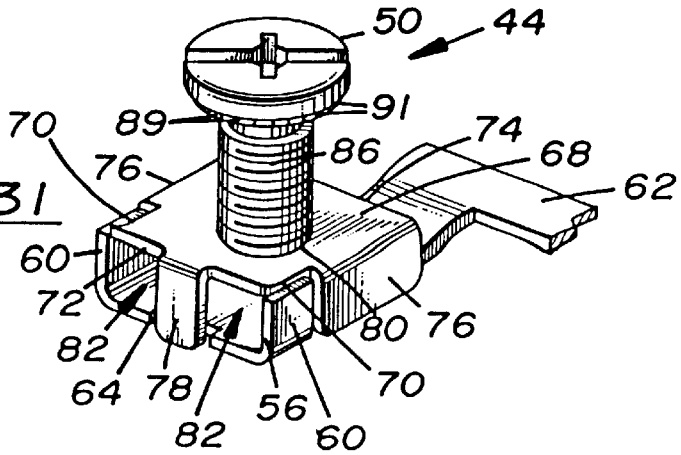
FIG. 31 is an assembled perspective view of the back wired clamping arrangement of FIG. 30.
Figure 33:
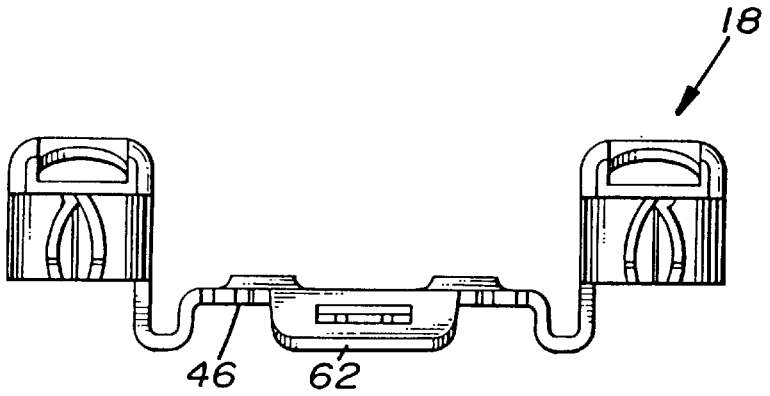
FIG. 33 is a front plan view of the contact terminal assembly as seen along line 33—33 of FIG. 32.
Figure 32:
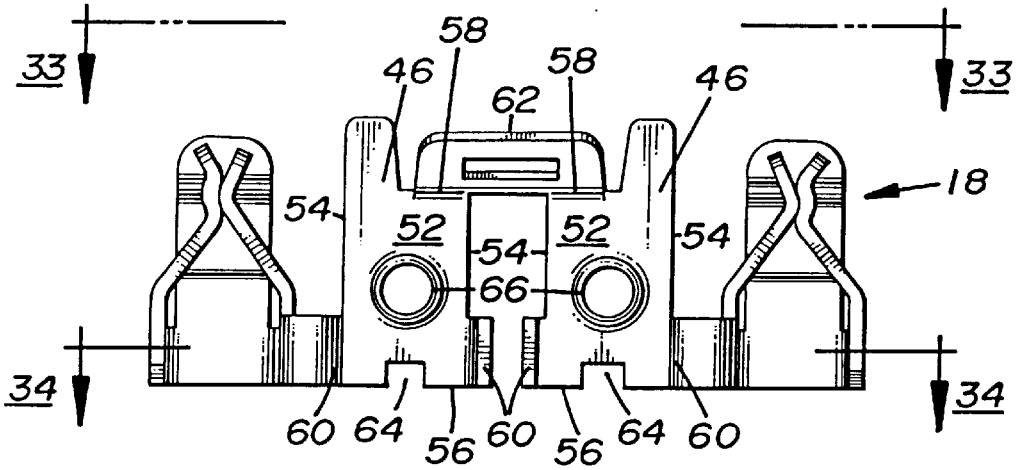
FIG. 32 is a side elevational view of the contact terminal assembly of FIG. 29.
Figure 34:
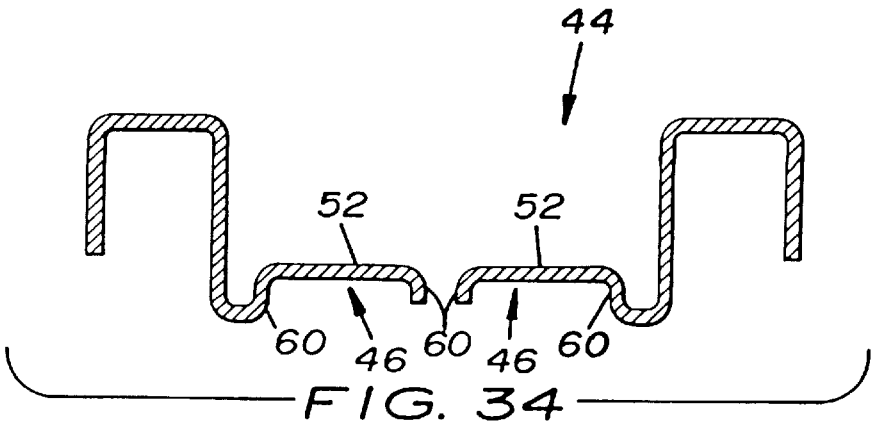
FIG. 34 is a cross-sectional view of the contact terminal assembly taken along line 34—34 of FIG. 32.
Figure 36:
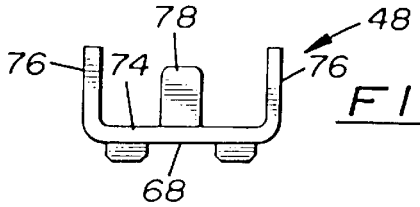
FIG. 36 is a front plan view of the clamp plate as seen along line 36—36 of FIG. 35.
Figure 38:
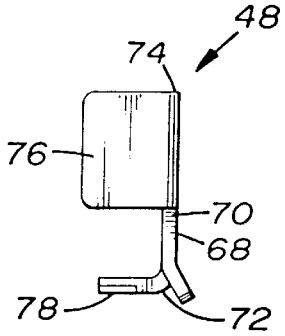
FIG. 38 is a side elevational view of the clamp plate as seen along line 38—38 of FIG. 35.
Figure 35:
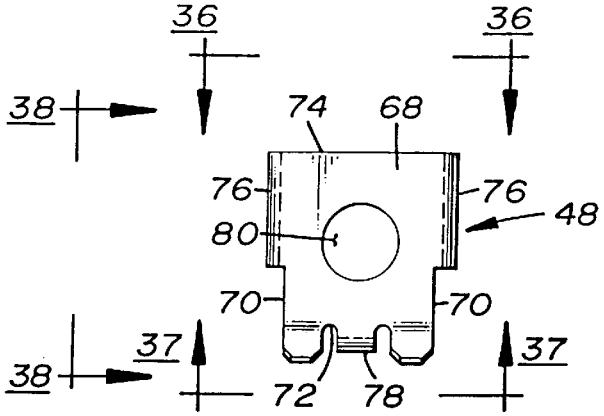
FIG. 35 is a side elevational view of a clamp plate of the back wired clamping arrangement of FIG. 30.
Figure 39:
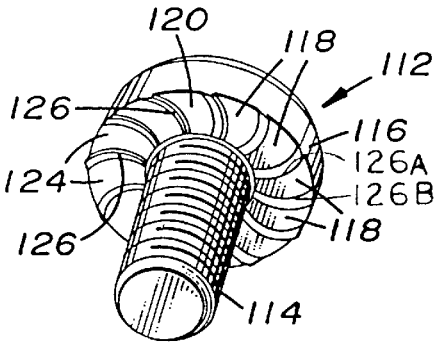
FIG. 39 is a perspective view of an enhanced terminal screw of the present invention used in the receptacle of FIG. 1.
Figure 37:
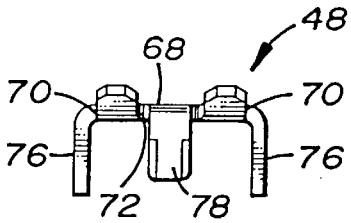
FIG. 37 is a rear plan view of the clamp plate as seen along line 37—37 of FIG. 35.
Figure 41:
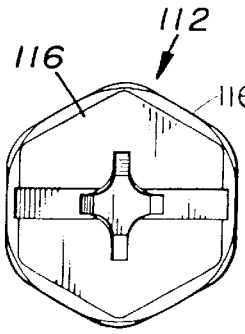
FIG. 41 is a top plan view of the screw as seen along line 41—41 of FIG. 40.
Figure 40:
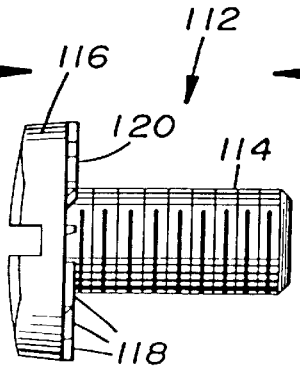
FIG. 40 is a side elevational view of the screw of FIG. 36.
Figure 42:
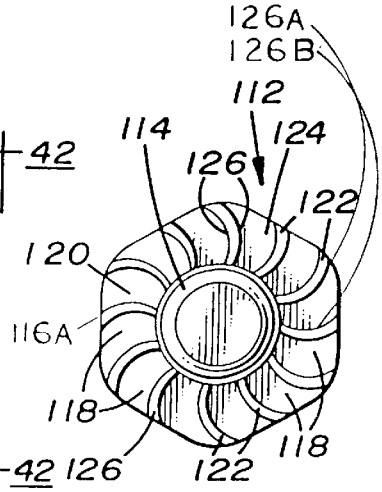
FIG. 42 is a bottom plan view of the screw as seen along line 42—42 of FIG. 40.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

In General

Referring to the drawings and particularly to FIG. 1, there is illustrated an electrical receptacle, generally designated 10, incorporating the features of the present invention as well as the features of the other inventions of the applications cross-referenced above. The electrical receptacle 10 basically includes a receptacle body 12, a base body 14, a pair of contact terminal assemblies 16, 18 and a U-shaped mounting bridge 20.

The receptacle body 12 of the receptacle 10 has a front side 12A with a pair of plug terminal contact receiving openings 22 formed therein, an opposite rear side 12B, and pairs of opposite ends 12C and sides 12D. The base body 14 of the receptacle 10 has opposite front and rear faces 14A, 14B and mates at its front face 14A with the rear side 12B of the receptacle body 12. The contact terminal assemblies 16, 18 of the receptacle 10 fit through respective cavities 24, 26 in the receptacle and base bodies 12, 14 such that the assemblies 16, 18 are aligned with pairs of the openings 22 of the receptacle body 12 for receiving therethrough and in electrically engagement with the assemblies 16, 18 the prongs of an electrical plug (not shown).

The mounting bridge 20 of the receptacle 10 has a base portion 28 for positioning adjacent the rear face 14B of the base body 14 and a pair of opposite leg portions 30 extending forwardly from opposite ends of the base portion 28 along opposite ends 12C of the receptacle body 12. The opposite ends 12C of the receptacle body 12 have lugs 31 with ramps 31A which snap fit within cutouts 30A defined in the opposite leg portions 30 of the mounting bridge 20 to secure the mounting bridge 20 to the receptacle body 12. The mounting bridge 20 also has pairs of arcuate-shaped wing portions 32 attached to the opposite leg portions 30 for inserting into slots 34 formed into the rear comers 12E of the receptacle body 12 and around the comers 14C of the base body 14 which fit within the rear comers 12E of the receptacle body 12. The mounting bridge 20 is thereby adapted to secure the receptacle and base bodies 12, 14 together in a mated relationship and captures the contact terminal assemblies 16, 18 therebetween. The bridge 20 also mounts ground contact assemblies 36 (FIGS. 9–11 and 14) which align with other of the openings 22 on the front side 12A of the receptacle body 12 for receiving a ground prong or pin of the electrical plug (not shown). The bridge 20 further has mounting tabs 38 attached to the opposite leg portions 30 and extending outwardly therefrom in opposite directions with eyelets 40 on the mounting tabs 38 and holes 38A through the tabs 38 for fastening the receptacle 10 to an external structure, such as a building wall, by the use of screws 42 inserted through the holes 38A and threaded into the structure.

Back Wired Clamping Arrangement

Referring now to FIGS. 1 and 27 to 38, there is illustrated a back wired clamping arrangement, generally designated 44, of the first application cross-referenced above. The back wired clamping arrangement 44 basically includes a base plate 46, a clamp plate 48 and a fastening means 50. The base plate 46 is connected to one of the contact terminal assemblies 16, 18 of the electrical receptacle 10. Each contact terminal assembly 16, 18 has a pair of base plates 46 connected thereto. The base plates 46 of each contact terminal assembly 16, 18 are interconnected and disposed in a side by side relationship to one another. Each contact terminal assembly 16, 18 receives a pair of the clamp plates 48 such that each clamp plate 48 interfits with one of the base plates 46. Each contact terminal assembly 16, 18 utilizes a pair of the fastening means 50. Each fastening means 50 secures a base plate 46 and a clamp plate 48 to one another.

The base plate 46 has a main body portion 52 with opposite side edges 54, a front edge 56 and a rear edge 58 together extending about and substantially surrounding the main body portion 52, and a pair of opposite forward side tabs 60 formed on the side edges 54. The main body portion 52 has a substantially flat configuration. The main body portion 52 of one base plate 46 is interconnected via a flange 62 to the main body portion 52 of the adjacent base plate 46 on the same contact terminal assembly 16, 18. The flange 62 extends between and is connected at the rear edges 58 of the base plates 46. Each forward side tab 60 extends outwardly from and along one of the side edges 54 from the front edge 56 to a point spaced from the rear edge 58. Each forward side tab 60 has a substantially rectangular configuration and is disposed in substantially perpendicular relation to the main body portion 52. The base plate 46 has a recess 64 defined in the front edge 56 thereof. The recess 64 is spaced an equal distance from each of the side edges 54. The recess 64 has a substantially three-sided U-shaped configuration. The base plate 46 also has a central passageway 66 defined through the main body portion 52 which is internally threaded and has a substantially circular configuration.

The clamp plate 48 has a main body portion 68 with opposite side edges 70, a front edge 72 and a rear edge 74 together extending about and substantially surrounding the main body portion 68, and a pair of opposite rearward side tabs 76 formed on the side edges 54 and a front tab 78 formed on the front edge 72. The main body portion 68 has a substantially flat configuration. Each rearward side tab 76 extends outwardly from and along one of the side edges 70 from the rear edge 74 to a point spaced from the front edge 72. Each rearward side tab 76 has a substantially rectangular configuration and is disposed in substantially perpendicular relation to the main body portion 68. The rearward side tabs 76 of the clamp plate 48 and the forward side tabs 60 of the base plate 46 are disposed in substantially parallel relation to one another. The rearward side tabs 76 of the clamp plate 48 and the forward side tabs 60 of the base plate 46 together form side walls. The front tab 78 extends outwardly from and along the front edge 72. The front tab 78 is spaced an equal distance from each of the side edges 70. The front tab 78 has a substantially rectangular configuration and is disposed in substantially perpendicular relation to the main body portion 68 and to the rearward side tabs 76 and to the forward side tabs 60. The front tab 78 inserts within the recess 64 of the base plate 46 and forms a front wall. With respect to their relative sizes, the area of each forward side tab 60 is greater than the area of the front tab 78 and less than the area of each rearward side tab 76. The clamp plate 48 has a central hole 80 defined through the main body portion 68. The central hole 80 has a substantially circular configuration and is aligned with the central passageway 66 of the base plate 46.

The clamp plate 48 and the base plate 46 together define at least one and, preferably, a pair of channels 82. Each channel 82 is for receiving a multi-stranded wire 84 therethrough such that the base and clamp plates 46, 48 substantially enclose and make electrical contact with the strands of the wire 84. The channels 82 are disposed in substantially parallel relation to one another. Each channel 82 is open at the front edges 56, 72 and at the rear edges 58, 74 of the base and clamp plates 46, 48. The side walls formed by the forward side tabs 60 of the base plate 46 and the rearward side tabs 76 of the clamp plate 48 and the main body portion 52 of the base plate 46 and the main body portion 68 of the clamp plate 48 all together provide each channel 82 with a substantially three-sided U-shaped configuration in transverse cross-section and such that the base plate 46 and the clamp plate 48 enclose and make electrical contact with the strands of the wire 84 on three sides. The front wall formed by the front tab 78 of the clamp plate 48 separates the channels 82 at the front edges 56, 72 of the base and clamp plates 46, 48. The front wall makes electrical contact with the strands of the wire 84 on a fourth side.

The fastening means 50 includes the central passageway 66 of the base plate 46, the central hole 80 of the clamp plate 48 and a screw 86. The screw 86 is any conventional type. The screw 86 is disposed through the central hole 80 of the clamp plate 48 and threadably inserted through the central passageway 66 of the base plate 46 and thereby secures the clamp plate 48 to the base plate 46. The screw 86 also makes electrical contact with the strands of the wire 84 on the fourth side. The screw 86 combines with the main body portions 52, 68 of the base and clamp plates 46, 48 and with one of the side walls formed by the forward side tabs 60 of the base plate 46 and the rearward side tabs 76 of the clamp plate 48 and with the front wall formed by the front tab 78 of the clamp plate 48 to enclose and make electrical contact with the strands of the wire 84 on four sides of the wire 84. The screw 86 separates the channels 82 at an intermediate point between the front edges 56, 72 and the rear edges 58, 74 of the base and clamp plates 46, 48. The screw 86 and the base and clamp plates 46, 48 securely bundle together the strands of the wire 84 during insertion into one of the channels 82 so as to prevent the strands of the wire 84 from spreading apart. The fastening means 50 may also include an anti-vibration washer 88 having an endless row of resiliently yieldable peripheral tabs 89 separated by slots 91. The washer 88 is disposed on the screw 86 such that its tabs 89 will apply pressure on the clamp plate 48 so as to retain the clamping action of the base and clamp plates 46, 48 on the wire 84 during vibration of the electrical receptacle 10.

Four-Sided Ground Contact Assembly

Referring now to FIGS. 1 to 8, there is illustrated the four-sided ground contact assembly, generally designated 90, being the invention of the second application cross-referenced above. The four-sided ground contact assembly 90 basically includes a first contact element 92 and a second contact element 94. Each of the first and second contact elements 92, 94 is mounted to the mounting bridge 20 of the electrical receptacle 10. The first contact element 92 has a pair of opposing contact leg portions 96 and a base portion 98. The second contact element 94 similarly has a pair of opposing contact leg portions 100 and a base portion 102. The leg portions 96, 100 of the first and second contact elements 92, 94 are circumferentially spaced from one another and provide four points of contact respectively on four sides of a ground prong or pin of an electrical plug (not shown).

The leg portions 96 of the first contact element 92 are spaced approximately 180° apart. The leg portions 100 of the second contact element 94 are spaced approximately 180° apart. Each leg portion 96, 100 of the first and second contact elements 92, 94 is spaced approximately 90° apart from an adjacent one of the leg portions 96, 100 of the first and second contact elements 92, 94. Also, each of the first and second contact elements 92, 94 has a substantially U-shaped configuration. Each leg portion 96, 100 of the first and second contact elements 92, 94 has an upper end 96A, 100A and a lower end 96B, 100B. The points of contact of the leg portions 96, 100 are at 104. The point of contact 104 of the leg portion 96, 100 is disposed closer to the upper end 96A, 100A than to the lower end 96B, 100B of the leg portion 96, 100. Each leg portion 96 is made of a yieldable resilient material providing a spring bias of one leg portion 96 toward the other leg portion 96. Similarly, each leg portion 100 is made of a yieldable resilient material providing a spring bias of one leg portion 100 toward the other leg portion 100.

The base portion 98, 102 of the first and second contact elements 92, 94 extend between and connect with the lower ends 96B, 100B of the respective leg portions 96, 100 of the first and second contact elements 92, 94. The base portion 98 of the first contact element 92 is integral with the base portion 28 of the mounting bridge 20. The base portion 102 of the second contact element 94 is disposed above the base portion 98 of the first contact elements 92 and is mounted to the base portion 98 and thus to the mounting bridge 20 by a rivet 105 or the like. The base portion 102 of the second contact element 94 is slightly bowed upwardly such that the base portion 102 when secured by the rivet 105 to the mounting bridge 20 will contact the bridge 20 along the entire length of the base portion 102.

The points of contact 104 of each pair of leg portions 96, 100 of the first and second contact elements 92, 94 are disposed closer to one another than are the upper ends 96A, 100A or the lower ends 96B, 100B of the pairs of leg portions 96, 100. A portion of each leg portion 96, 100 between the point of contact 104 and the upper end 96A, 100A is arcuate shaped. A centerline C extends vertically between the pairs of the leg portions 96, 100 and represents the approximate location of the ground pin of the electrical plug. The upper end 96A, 100A of each leg portion 96, 100 is spaced from the centerline C approximately the same distance as the lower end 96B, 100B of each leg portion 96, 100.

Mounting Bridge with Enhanced Barbs

Referring now to FIGS. 1 and 9 to 26, there is illustrated a plurality of enhanced barbs, generally designated 106, being the invention of the third application cross-referenced above. The barbs 106 are provided on the mounting bridge 20 of the electrical receptacle 10. Each barb 106 is mounted on one of the arcuate-shaped wing portions 32 attached to the opposite leg portions 30 of the mounting bridge 20. The mounting bridge 20 preferably has four barbs 106. When the mounting bridge 20 is mated with the receptacle body 12 of the electrical receptacle 10, each barb 106 inserts into one of the slots 34 formed into the rear corners 12E of the receptacle body 12.

Each barb 106 basically includes an upright tab 108 and a plurality of teeth 110. The upright tab 108 of each barb 106 is mounted to one of the wing portions 32 of the mounting bridge 20. The teeth 110 are formed on the upright tab 108 and project outwardly therefrom in three directions such that the teeth 110 engage and bite into three sides of a respective one of the slots 34 of the receptacle body 12. The three directions which the teeth 110 project are orthogonal in relation to one another.

Each of the upright tabs 108 has a substantially rectangular configuration. The upright tab 108 has opposite side edges 108A and opposite inward and outward facing side surfaces 108B, 108C in relation to the mounting bridge 20. There are preferably two pairs or four teeth 110 associated with each tab 108. Each tooth 110 preferably has a substantially wedge-shaped three-dimensional configuration. One pair of the teeth 110 project from one of the opposite side edges 108A and the outward facing side surface 108C of the upright tab 108. The other pair of teeth 110 project from the other of the opposite edges 108A and the outward facing side surface 108C of the upright tab 108.

Terminal Screw With Impeller Wire Gripping Elements

Referring now to FIGS. 1 and 39 to 42, there is illustrated an enhanced terminal screw, generally designated 112, of the present invention. The screw 112 basically includes a shank 114, a head 116 and a plurality of impeller wire gripping elements 118. The shank 114 has opposite ends 114A, 114B. The head 116 is mounted to the opposite end 114A of the shank 114 and has an outer peripheral edge 116A that surrounds and is spaced from the shank 114. The head 116 has an underside surface 120. The impeller wire gripping elements 118 formed on the underside surface 120 of the head 116 grip a wire (not shown) which partially surrounds the shank 114 and tend to more tightly wrap the wire around and radially inwardly toward the shank 114 as the screw 112 is tightened relative to the wire.

The impeller wire gripping elements 118 are spirally arranged on the underside surface 120 of the head 116. Also, the impeller wire gripping elements 118 are symmetrically arranged about the shank 114. Each impeller wire gripping element 118 has an arcuate shape. The underside surface 120 of the head 116 defines a plurality of circumferentially spaced apart grooves 122. The impeller wire gripping elements 118 are constituted by a plurality of lands 124 formed between the spaced apart grooves 122 on the underside surface 120 of the head 116. Each land 124 has opposite edges 126 adjacent to and spaced from such edges of other lands 124 by the widths of the grooves 122 so as to provide the gripping surfaces. More particularly, the grooves 122 are arcuate shaped and extend continuously from the shank 114 to the peripheral edge 116A of the head 116 so that each of the plurality of lands 124 has a concave side 126A and an opposite convex side 126B such that the plurality of lands 124 grip a wire partially surrounding the shank 114 and force the wire radially inwardly toward the shank 114 as the screw 112 is rotated in a predetermined direction and tightened relative to the wire.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An enhanced terminal screw for use in an electrical receptacle, said screw comprising:

(a) a shank having opposite ends;

(b) a head mounted to one of said opposite ends of said shank and having an underside surface and an outer peripheral edge surrounding and spaced from said shank; and (c) a plurality of impeller wire gripping lands formed on said underside surface of said head by a plurality of grooves formed in said underside surface of said head and circumferentially spaced apart from each other about said shank, said grooves being arcuate shaped and extending continuously from said shank to said peripheral edge of said head so that each of said plurality of lands has a concave side and an opposite convex side such that said plurality of lands grip a wire partially surrounding said shank and force the wire to move radially inwardly toward said shank as said screw is rotated in a predetermined direction and tightened relative to the wire.

2. The screw as recited in claim 1, wherein said impeller wire gripping lands are spirally arranged on said underside surface of said head.

3. The screw as recited in claim 1, wherein said impeller wire gripping lands are symmetrically arranged about said shank.

* * * * *